US005539283A

United States Patent [19]

Piejak et al.

[11] Patent Number: 5,539,283

[45] Date of Patent: Jul. 23, 1996

[54] DISCHARGE LIGHT SOURCE WITH REDUCED MAGNETIC INTERFERENCE

[75] Inventors: Robert B. Piejak, Wayland; Benjamin Alexandrovich; Valery A. Godyak, both of Brookline, all of Mass.

[73] Assignee: Osram Sylvania Inc., Danvers, Mass.

[21] Appl. No.: 490,216

[22] Filed: Jun. 14, 1995

[51] Int. Cl.[6] ..... H05B 41/16

[52] U.S. Cl. ..... 315/248; 315/344; 315/85; 315/39; 313/492; 313/493

[58] Field of Search ..... 315/248, 338, 315/344, 85, 70, 71, 39; 313/492, 493, 232, 242, 485–488

[56] References Cited

U.S. PATENT DOCUMENTS

| | | | |
|---|---|---|---|
| 4,245,179 | 1/1981 | Buhrer | 315/248 |
| 4,254,363 | 3/1981 | Walsh | 315/248 |
| 4,383,203 | 5/1983 | Stanley | 315/248 |
| 4,427,925 | 1/1984 | Proud et al. | 315/248 |
| 4,568,859 | 2/1986 | Houkes et al. | 315/348 |
| 4,645,967 | 2/1987 | Bouman et al. | 313/248 |
| 4,704,562 | 11/1987 | Postma et al. | 315/248 |
| 4,727,294 | 2/1988 | Houkes et al. | 315/248 |
| 4,920,297 | 4/1990 | van der Heijden | 313/315 |
| 4,940,923 | 7/1990 | Kroontje et al. | 315/248 |
| 5,300,860 | 4/1994 | Godyak et al. | 315/39 |
| 5,325,018 | 6/1994 | El-Hamamsy | 315/85 |

*Primary Examiner*—Robert Pascal
*Assistant Examiner*—Haissa Philogene
*Attorney, Agent, or Firm*—Carlo S. Bessone

[57] ABSTRACT

A simple and effective technique for reducing an external magnet flux emitted from a driven inductor surrounded by an ionizable gaseous medium. This technique includes surrounding the inductor with at least one shielding conductive loop, terminating the shielding loop in a capacitive termination to resonate, and maintaining a resonant frequency of the capacitive termination in series with an inductance of the shielding loop below the predetermined driving frequency of the inductor.

22 Claims, 9 Drawing Sheets

DISCHARGE LIGHT SOURCE WITH REDUCED MAGNETIC INTERFERENCE

FIELD OF THE INVENTION

The present invention relates to an inductive discharge light source, and more particularly, to a discharge light source with a reduced external magnetic interference.

BACKGROUND OF THE INVENTION

It is well known that inductively coupled electrodeless low pressure discharge lamps offer many advantages. A typical inductively coupled discharge lamp comprises a lamp bulb which is sealed in a vacuum-tight manner and is filled with a metal vapor and a rare gas at a very low pressure. The inductor is energized by a high-frequency power supply (above 20 KHz) and thus provides a discharge in the space between the inductor and a fluorescent layer covering the internal surface of the lamp bulb.

A problem occurring during the operation of a gas discharge lamp is that electromagnetic fields are produced outside the lamp which cause high frequency interference currents in the power supply lines. As a result, especially due to the magnetic component of the field, disturbances may occur in other electrical apparatuses (such as radio and TV receivers) connected to the supply lines. Therefore, reduction of electro-magnetic interference (EMI), and especially its magnetic component, is one of the most important issues for commercially viable inductive discharge lamps.

Attempts have been undertaken in the field to reduce a magnetic flux that is found outside the lamp envelope of inductively coupled discharge lamps.

For example, U.S. Pat. Nos. 4,245,179 and 4,254,363 describe inductive primary coil geometries intended to reduce the total magnetic flux from the discharge. However, these techniques are generally not very practical, and there is no readily-available data demonstrating their effectiveness in reducing external magnetic flux.

U.S. Pat. Nos. 4,645,967, 4,704,562, 4,727,294, 4,920,297 and 4,940,923 teach a set of conductive short circuited anti-interference rings 10, 11, 12 that are attached to the outside of the lamp envelope and surround the discharge vessel (best shown in FIG. 1). When a discharge is inductively excited, these rings 10, 11 and 12 create a current which induces a magnetic flux in a direction opposite to the primary flux that neutralizes some of the magnetic flux of the primary induction coil. Disadvantageously, this technique is not very effective and is found to reduce the magnetic flux emitted from the discharge by only about 1.8 to 2.0 decibels (dB) per ring. More effective techniques for reducing the magnetic component of electro-magnetic field produced by the discharge lamp, would be highly desirable in the field.

SUMMARY OF THE INVENTION

It is, therefore, an object of the present invention to provide a simple and effective technique for significantly reducing the external magnetic interference emitted from any inductive discharge maintained by an air-core or ferrite-core inductor driven by a radio-frequency power supply.

It is another object of the present invention to provide a discharge lamp with reduced magnetic interference.

Although the present invention may find its application in shielding a magnetic component of an EMI produced by inductively exited high frequency discharge, it finds its particular utility in reducing an external magnetic flux escaping from a discharge lamp.

According to the teaching of the present invention, an inductor immersed in a gaseous media and driven with a predetermined radio frequency, for maintaining an inductive discharge, is surrounded by a shielding conductive loop. The shielding loop is terminated in a capacitive termination to resonate at a resonant frequency which is maintained below the predetermined driving frequency of the inductor.

The gaseous medium, containing a rare gas (selected from the group of inert gases) and a vaporized metal (preferably, mercury and sodium), is enclosed in a sealed transparent lamp envelope. A layer of fluorescent material is deposited on the internal surface of the lamp envelope, and the inductor is received in the lamp envelope.

A power supply means applies a high-frequency power to a primary coil of the inductor to induce an electro-magnetic field within the lamp envelope for maintaining the inductive discharge in the gaseous medium. This fluorescent material is responsive to the discharge in the gaseous medium for emitting light.

The shielding loop may be secured outside or inside of the lamp envelope and may be formed as a conductive film deposited on the lamp envelope. Also, the shielding loop may include a plurality of independent shielding loops, each terminated in a respective capacitive termination, or a multi-turn conductive ring terminated in a capacitive termination.

The inductor includes either an air-core inductor or a ferrite-core inductor as long as it does not constitute a closed magnetic path.

The lamp envelope and the gaseous medium are selected for operation at a frequency of more than 1 MHz.

These and other objects of the present invention will become apparent from a reading of the following specification taken in conjunction with the enclosed drawings.

DETAILED DESCRIPTION OF THE PREFERRED EMBODIMENT

Figure 1:
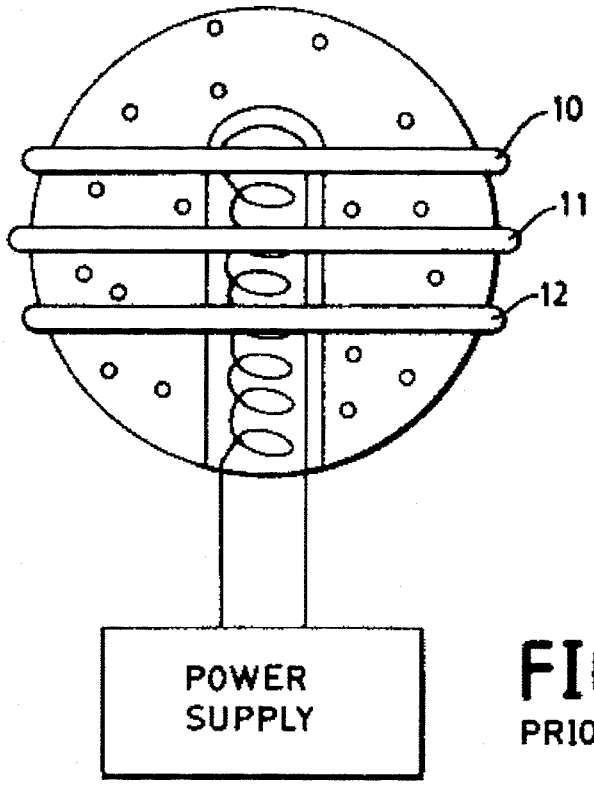
FIG. 1 PRIOR ART
FIG. 1 is a schematical view of an electrodeless low pressure discharge lamp having anti-interference rings according to the prior art.
Figure 2:
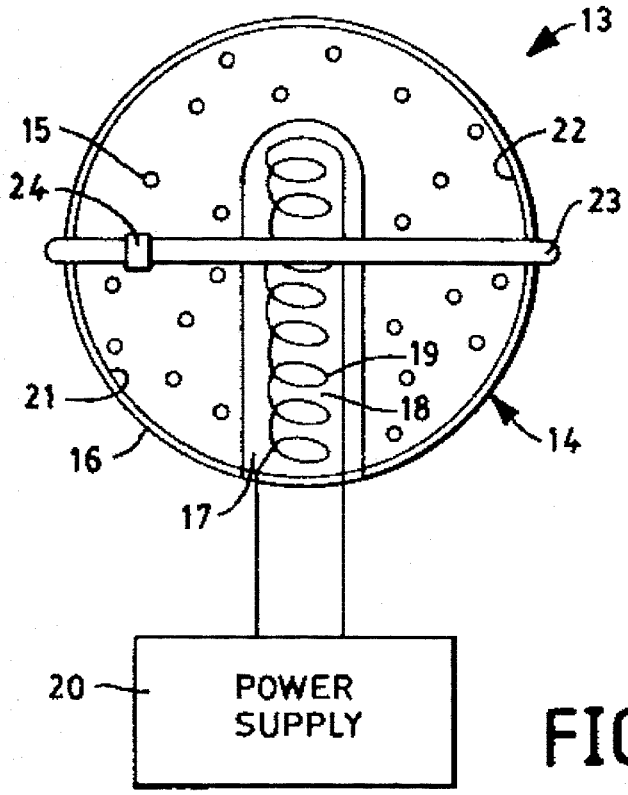
FIG. 2 is a schematic diagram of a magnetic interference reduction technique according to the present invention.

Referring to FIG. 2, an electrodeless low pressure discharge lamp 13 includes a transparent glass lamp envelope 14 which is sealed in a gas-tight manner and contains a rare gas (for instance, argon) and a vaporized metal (for instance, mercury) at very low pressure constituting an ionizable gaseous medium 15. The lamp envelope 14 has a bulb 16 and a cavity 17 (or a reentrant part of the lamp envelope 14) 17, wherein a primary coil 18 is provided, which comprises a plurality of turns of copper wire. The primary coil 18 is a part of an inductor 19, which may be an air-core inductor or a ferrite-core inductor. If the ferrite-core inductor 19 is chosen, a rod-shaped core (the core can be a ferrite tube) of magnetic material (ferrite) surrounded by the primary coil 18 is provided within the cavity 17.

The primary coil 18 is connected to a high-frequency power supply unit 20 (shown schematically) such that a high-frequency electromagnetic field can be induced in the lamp envelope 14.

Inner wall 21 of the lamp 14 is coated with a transparent layer 22 of a light-emitting substance, usually a mixture of several fluorescent or phosphorescent metallic salts (such as calcium tungstate, zinc sulphide and/or zinc silicate).

During the operation of the lamp 13, a high frequency electro-magnetic field is induced in the lamp envelope 14, and insures that an inductive discharge is maintained within the lamp envelope 14. The discharge consists for the most part of ultraviolet rays, which are invisible. The ultraviolet light strikes the fluorescent substance of the layer 22 to emit radiation with a longer wave length in the visible range of the spectrum. By suitable choice of the fluorescent substance, this light can be given any desired color.

The discharge lamp 13 operated at such high frequencies (in excess of 20,000 Hz), can produce electro-magnetic interference external to the lamp envelope 14, potentially capable of disturbing radio and television reception in the vicinity of the lamp and the most serious problem may be caused by the external magnetic flux.

Figure 3:
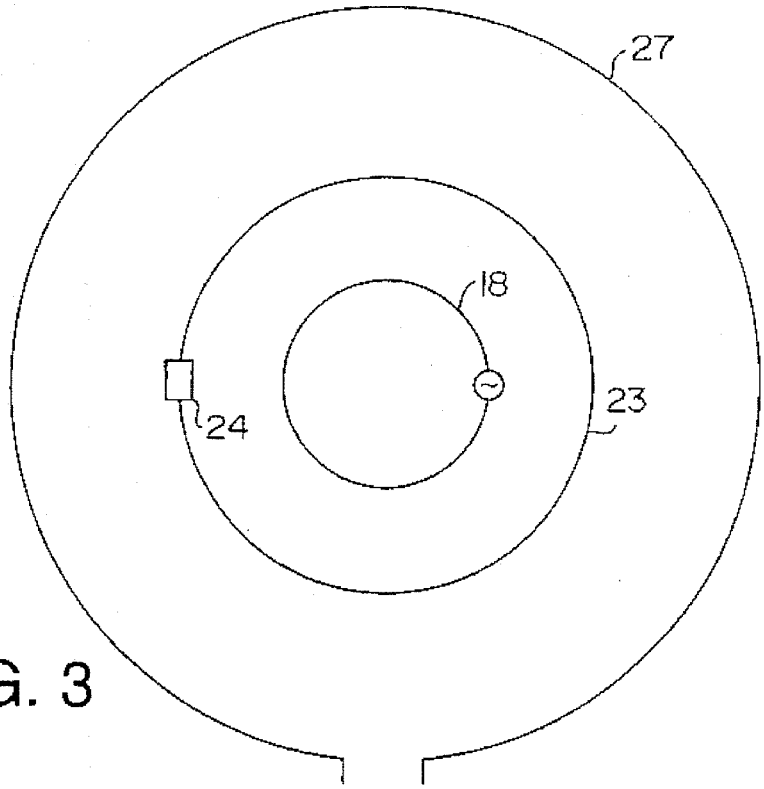
FIG. 3 shows, diagrammatically, an electrodeless low pressure discharge lamp with a shielding loop according to the present invention.

In order to substantially reduce this undesired external magnetic interference, the discharge lamp 13 is provided with at least one shielding conductive lamp 23, best shown in FIGS. 2 and 3. The shielding loop 23 surrounds the discharge generated and maintained within the lamp envelope 14. For ease of illustration, only one shielding loop 23 is shown in FIGS. 2 and 3; however, more than one shielding loop can be employed if desired.

Each shielding loop 23 is terminated in an appropriate reactance 24. When the discharge is inductively excited, the shielding loop 23 creates a current which induces a magnetic flux in a direction opposite to the primary flux outside the primary coil, thereby effectively neutralizing some of the magnetic flux of the primary induction coil 18. Since the created current flow in the loop 23 is greater than that in the simple closed ring (as in the prior art), a reduction of the magnetic interference is observed to be between 6 dB and 25 dB in comparison with 1.8 to 2.0 dB when closed rings are employed.

Among other factors, the precise reduction in magnetic flux depends upon the coupling between the primary coil 18 and the shielding loop 23, the specific reactance 24 that the shielding loop 23 is terminated upon, and the difference between the frequency of discharge operation (a predetermined driving radio frequency) and the resonant frequency of the terminated loop 23.

The essential key to making this technique effective is choosing the correct reactance 24 in which to terminate the shielding loop 23 so that the current in that loop 23 is of the appropriate magnitude and is anti phase with respect to the current flowing through the primary coil 18 that maintains the discharge. Since the shielding loop 23 is always inductive in electrical nature, the termination reactance 24 overall is always capacitive in nature and may also include some resistance to broaden the frequency range of magnetic flux reduction (at the expense of a few dB of effectiveness).

It will be appreciated by those skilled in the art, that choosing the termination reactance 24 is not at all obvious. Maximum magnetic shielding is achieved at a frequency somewhat above the frequency at which the loop reactance and termination reactance combine to resonate. To significantly reduce magnetic flux external to a discharge lamp 13, the loop 23/termination 24 combination should resonate below the frequency that the discharge lamp 13 is driven. If the termination reactance 24 makes the shielding loop 23 resonate somewhat above the driving frequency, an opposite effect is observed and the magnetic flux external to the discharge lamp 13 is greater than it would be with no shielding loop 23 at all. Resonance of the shielding loop 23 with the termination 24 exactly at the driving frequency of the discharge lamp is also not desirable as this results in increased external magnetic flux and tremendously increases losses that show up in the primary coil 18.

Figure 4:
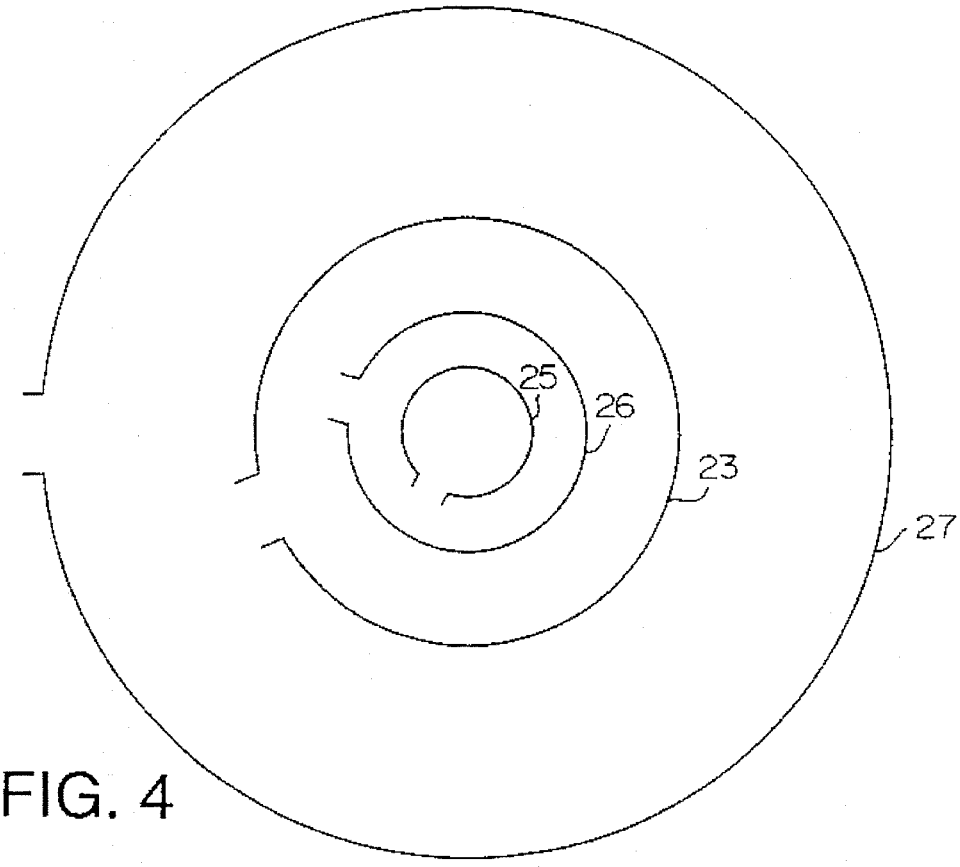
FIG. 4 is a schematic diagram of a test set-up.

In order to illustrate the above-described effect, the measurements were conducted using the test bed shown in FIG. 4 [FIG. 4 is a schematic representation of the geometry of the primary coil 18 and various loops used to demonstrate this effect.] The primary coil 18 (loop 25) consists of a four inch (4") long coil with twenty-eight (28) turns and an O.D. of about one and a quarter inches (1.25)". The inductance of this coil is about eight (8) uH. The electro-magnetic field (emf) check loop 26 has an O.D. of two inches (2") and is used to measure the emf at that diameter. The shielding loop 23 is a four inch (4") O.D. loop whose induced current balances out the magnetic flux produced by the primary coil 18. The termination reactance 24 is inserted in this shielding loop 23. The magnetic pick-up loop 27 is an electrostatically shielded magnetic pick-up loop with an O.D. of about fourteen (14"). This loop was used to indicate the amount of shielding achieved by the shielding loop 23. For all the tests described here the emf check loop 26 and the shielding loop 23 were in the mid plane of the primary induction coil 18. To demonstrate this magnetic shielding technique, gain/phase and impedance measurements were taken over a frequency spectrum about the driving frequency of the primary coil using an HP 4194A gain/phase and impedance analyzer.

Figure 5:
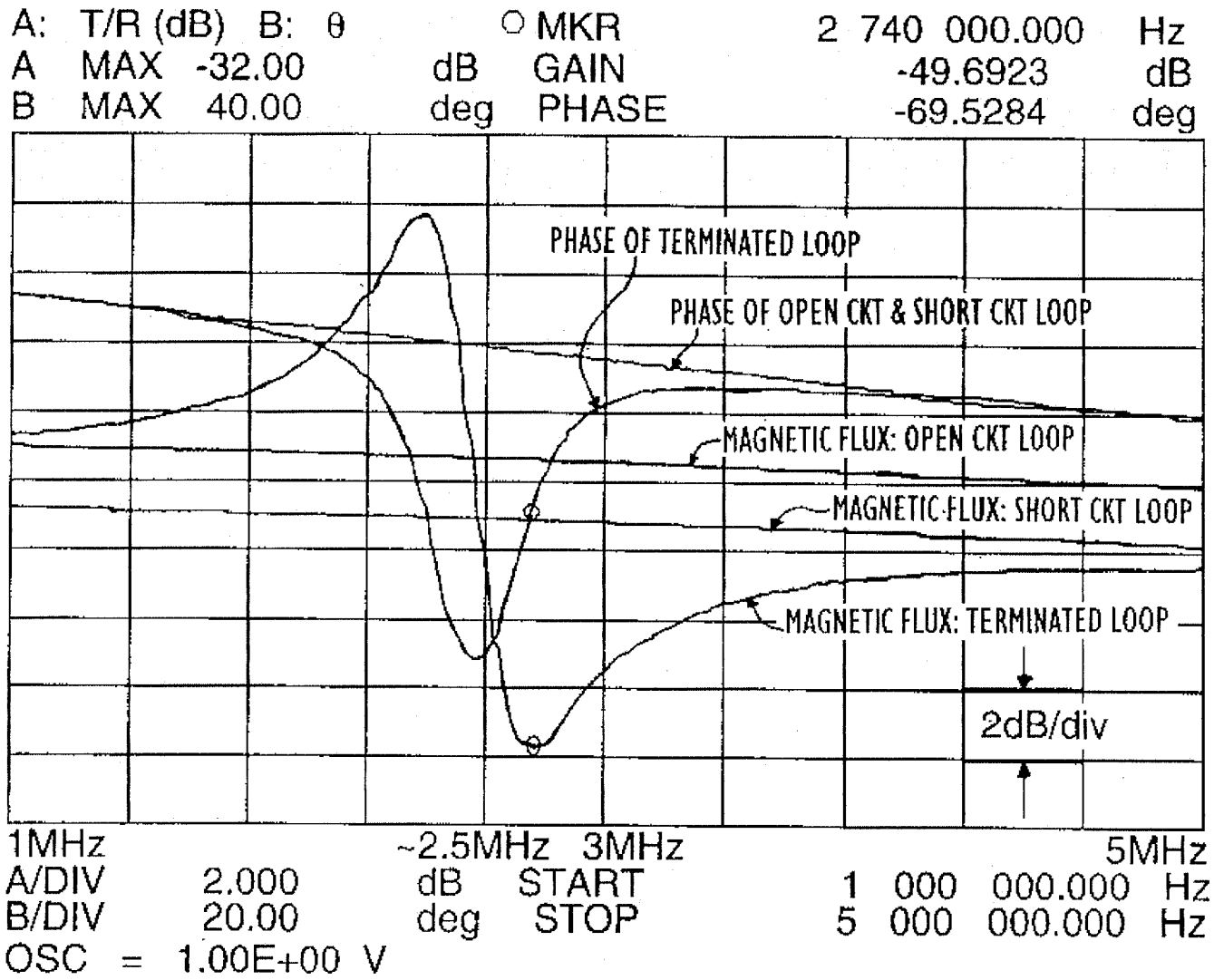
FIG. 5 is a diagram of the shielding with respect to voltage applied to the primary coil.

FIG. 5 shows the ratio of the magnitudes (in dB) and the phase difference between the primary coil voltage and the voltage induced onto the magnetic pick-up loop over a frequency range between 1 MHz and 5 MHz for three cases: an open circuited shielding loop (essentially no shielding), a short circuit shielding loop (prior art) and a terminated shielding loop (present invention). The voltage induced into the magnetic pick-up loop 27 is proportional to the magnetic interference from the driven primary coil 18. The decrease in the relative magnetic flux with frequency can be ignored in the case of open circuit since it simply represents the frequency response of the magnetic pick-up loop 27. The amount of magnetic shielding that occurs with respect to the voltage applied to the primary coil 18 is the difference between the magnetic flux with no shielding and that with a shielding loop (short circuit or terminated). FIG. 5 shows that the short circuit loop, as described in the prior art provides about 1.8 dB of shielding and is frequency independent. The terminated loop 23 provides "negative" shielding, i.e. enhancement of the magnetic flux from the primary coil 18, at frequencies below the resonance (about 2.5 MHz) of the terminated loop 23 while it provides substantially more shielding than the short circuit loop above its resonant frequency. The two circles show the point of maximum magnetic shielding and the corresponding phase response which occurs at 2.74 MHz. The maximum reduction in magnetic flux in this case is about 8 dB below the unshielded result. The behavior of this terminated loop is representative of their general behavior: at frequencies below the resonant frequency of a terminated loop, the magnetic flux pick-up increases; while at frequencies above its resonance, the relative magnetic flux pick-up decreases. From the relative magnitude of the magnetic flux and the phase data, it can be concluded that below resonance, the current flow in the terminated loop 23 is in the same direction as the primary coil and reinforces the magnetic flux it encloses; thus magnetic EMI from the primary coil increases. While above resonance, the current flow in the terminated loop 23 is opposite to the current flow in the primary coil 18 and it neutralizes (reduces) the total magnetic flux it encloses; thus the magnetic interference from the primary coil 18 decreases. Based on these measurements, the terminated loop 23 can be understood to be a frequency sensitive magnetic shielding technique which must resonate below the driving frequency of the discharge in order to be effective.

Figure 6:
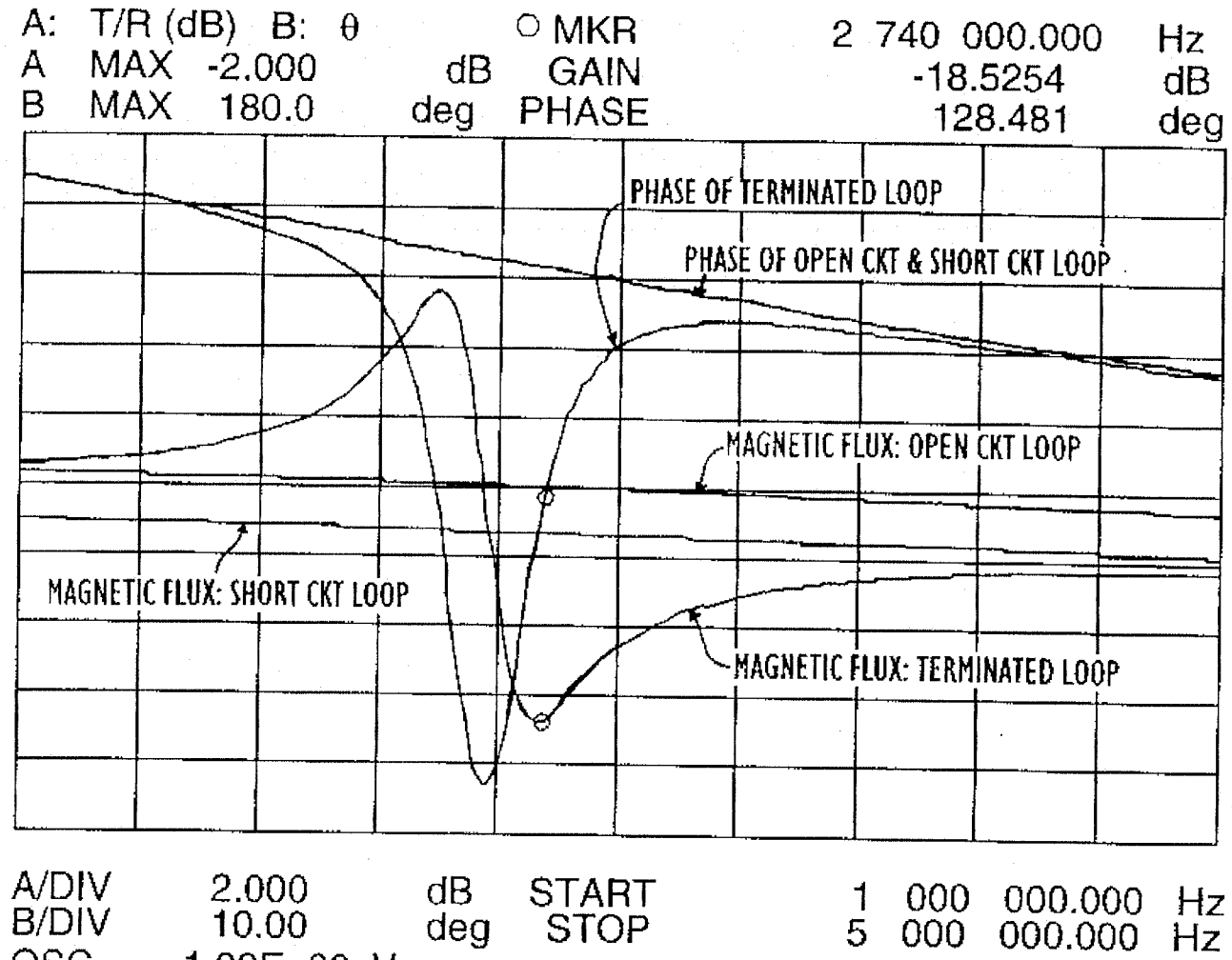
FIG. 6 is a diagram of the relative magnitude and phase of voltage induced on the check-loop in reference to the voltage induced on the magnetic pick-up loop.

The data shown in FIG. 5 indicates the magnitude of the shielding with respect to voltage applied to the primary coil 18; however, a more meaningful measure of the effectiveness of magnetic shielding is given by FIG. 6 showing the relative magnitude and phase of voltage induced on the emf-check loop 26 referenced to the voltage induced on the magnetic pick-up loop 27. Since the shielding loop 23 neutralizes some of the magnetic field from the primary coil 18, it slightly reduces the voltage induced on the emf-check loop 26. Since this induced voltage represents the driving voltage for the main component of the inductive discharge, the ratio between it and the external magnetic flux is a more precise measure of shielding effectiveness. Thus, FIG. 6 shows that the shorted loop effectively reduces magnetic interference by about 1.6 dB while the terminated loop reduces it by about 6.5 dB with respect to the voltage that would maintain the discharge.

Figure 7:
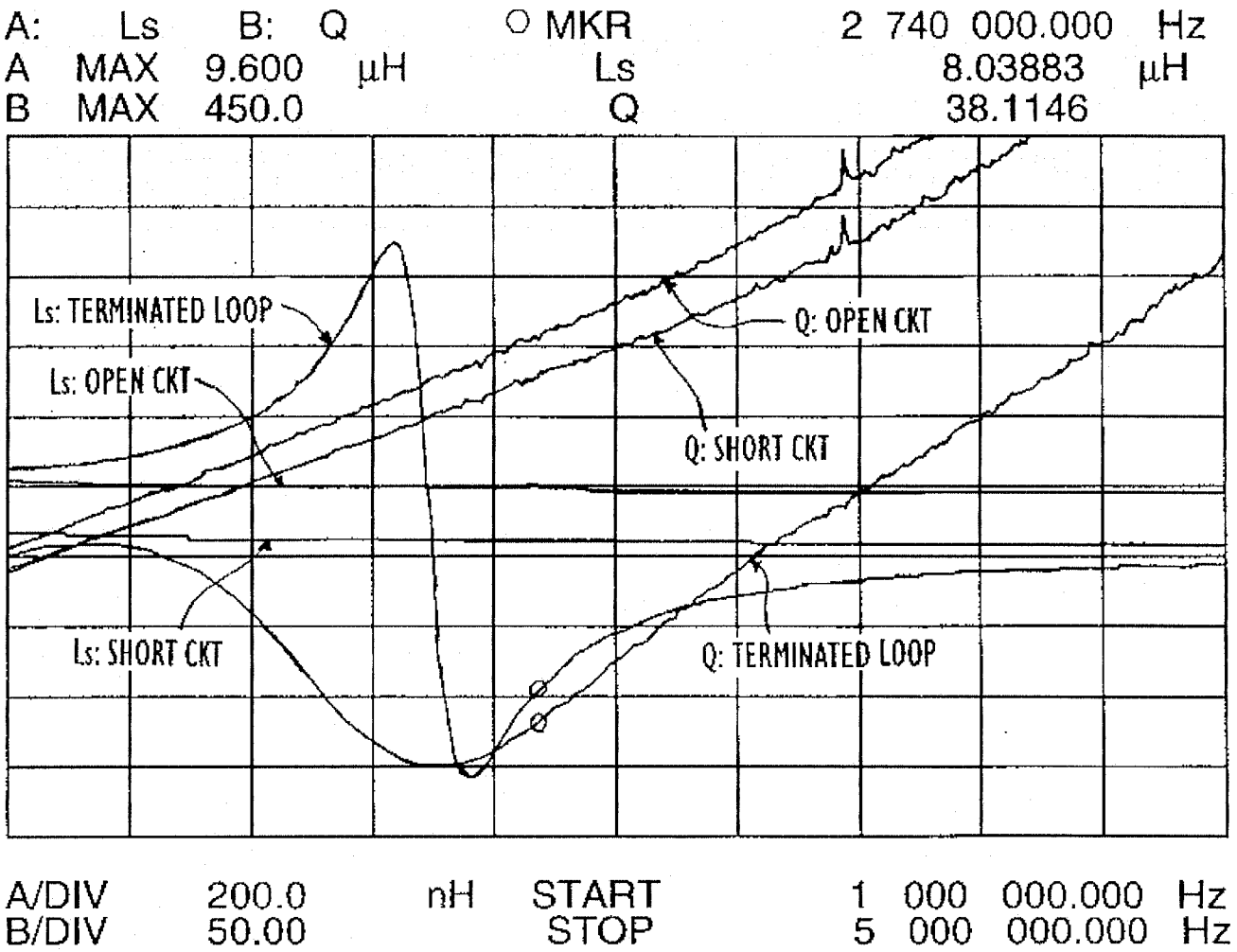
FIG. 7 is a diagram showing the series inductance and quality factor "Q" for the primary coil as a function of frequency for the three different terminations.

FIG. 7 shows the series inductance and quality factor "Q" for the primary coil as a function of frequency for the three different terminations of the shielding loop 23 mentioned earlier. This data supports the data of FIG. 5. The primary coil inductance, $L_s$, is almost constant for the open circuit loop; and is slightly less with the short circuit loop because the current through that loop slightly reduces the flux in the primary coil 18. In the case of the shielding (terminated) loop 23, $L_s$ is greater than the open circuit $L_s$ below resonance (indicating that the termination loop has a current flow that increases the total flux it encloses), while above resonance, $L_s$ is less than the open circuit $L_s$ (indicating that the terminating loop has a current flow that opposes the total flux it encloses). The peak variation in $L_s$ for this case is about ±9%.

The curves for the "Q" factor of the primary coil, also shown in FIG. 7, are also important to discuss since they indicate the practical "expense" of magnetic shielding. Over the range of frequencies shown here, the "Q" factor is greatest for the open circuit loop, slightly less for the short circuit loop and considerably less (depending on frequency) for the terminated loop, with the minimum "Q" factor occurring at resonance. This result simply indicates that the apparent Q factor of the primary coil includes the ohmic losses of the current flow in the shielding loop 23. So, in essence, power loss in the shielding loop 23 is the "price" of the reduction in magnetic EMI.

The "Q" factor of the primary coil at 2.74 MHz for the terminated loop 23 is 38 while it is about 300 when the shielding loop circuit is open. This severe degradation in "Q" factor in this case could pose a problem in a lamp discharge if the power dissipated in the shielding loop 23 significantly reduces the power transfer efficiency (discharge power/total power delivered the to coil) to an unacceptable level. A problem of whether or not a reduced "Q" factor is significant, is related to the phase angle between the voltage and the current of the discharge, the "Q" factor of the loop/termination circuit and the relationship between the driving frequency (to be suppressed) and the resonant frequency of the terminated loop. The low "Q" factor, observed in this case, is primarily due to the termination capacitor which was a "by-pass" type capacitor with a series resistance of 0.394 ohms at 2.7 MHz. The "Q" factor could be improved by using a higher quality terminating capacitor. A higher quality terminating capacitor would have a lower series resistance thus increasing the overall "Q" factor and improving magnetic shielding; this will be discussed below with the data taken at 6.78 MHz. In addition, it is clear from FIG. 7 that if this technique is used at a greater frequency, where maximum shielding is attained, the shielding would decrease somewhat but it still could be more effective than a short circuit loop and the "Q" factor at that frequency might be such that it would not significantly affect power transfer.

Figure 8:
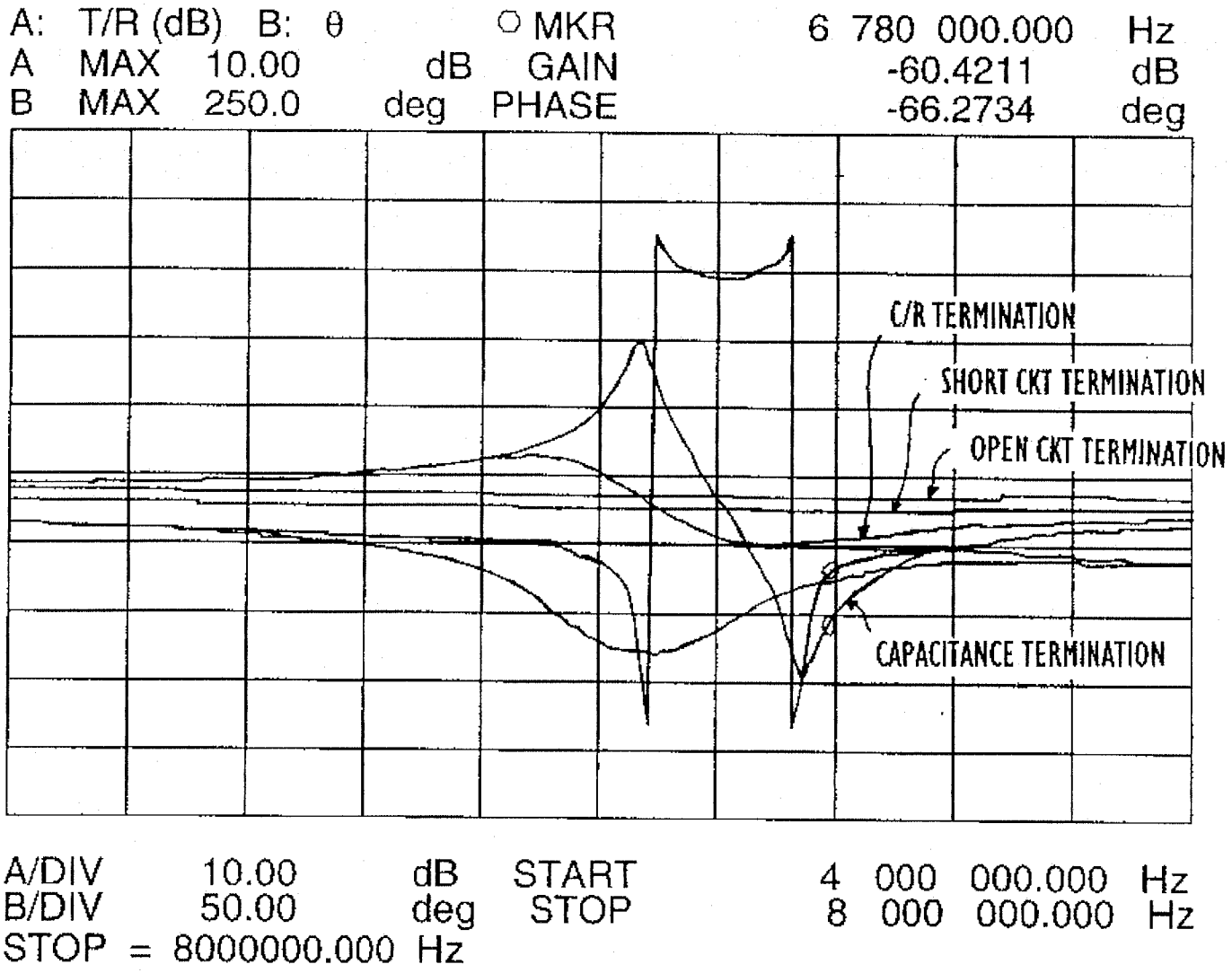
FIG. 8 is a diagram showing the magnitude of the voltage of the magnetic pick-up loop with respect to the primary coil voltage for four different terminations.

The effect of series resistance in the termination of the shielding loop on the shielding effectiveness and the primary coil "Q" factor was investigated at a somewhat higher frequency by measuring the magnitude of the voltage on the magnetic pick-up loop with respect to the primary coil voltage (as in FIG. 5) around 6 MHz. Four different terminations were used: an open circuit loop, a short circuit loop, a 1.88 nF silver mica capacitor ($R_s$=0.033 ohms) and a 1.88 nF silver mica capacitor in series with a 1.2 ohm resistor (from here on called C/R). The result of this measurement over a frequency range between 4 and 8 MHz is shown in FIG. 8. As it can be seen, the magnetic flux is about 2 dB down with the short circuit loop, up to about 26 dB down (maximum magnetic EMI reduction is about 20 times) with the 1.88 nF capacitor termination and about 6 dB down (maximum) with the C/R termination. At 6.78 MHz, an arbitrarily chosen frequency, the magnetic flux was about 16 dB down with the capacitor and about 5 dB down with the C/R termination.

Figure 9:
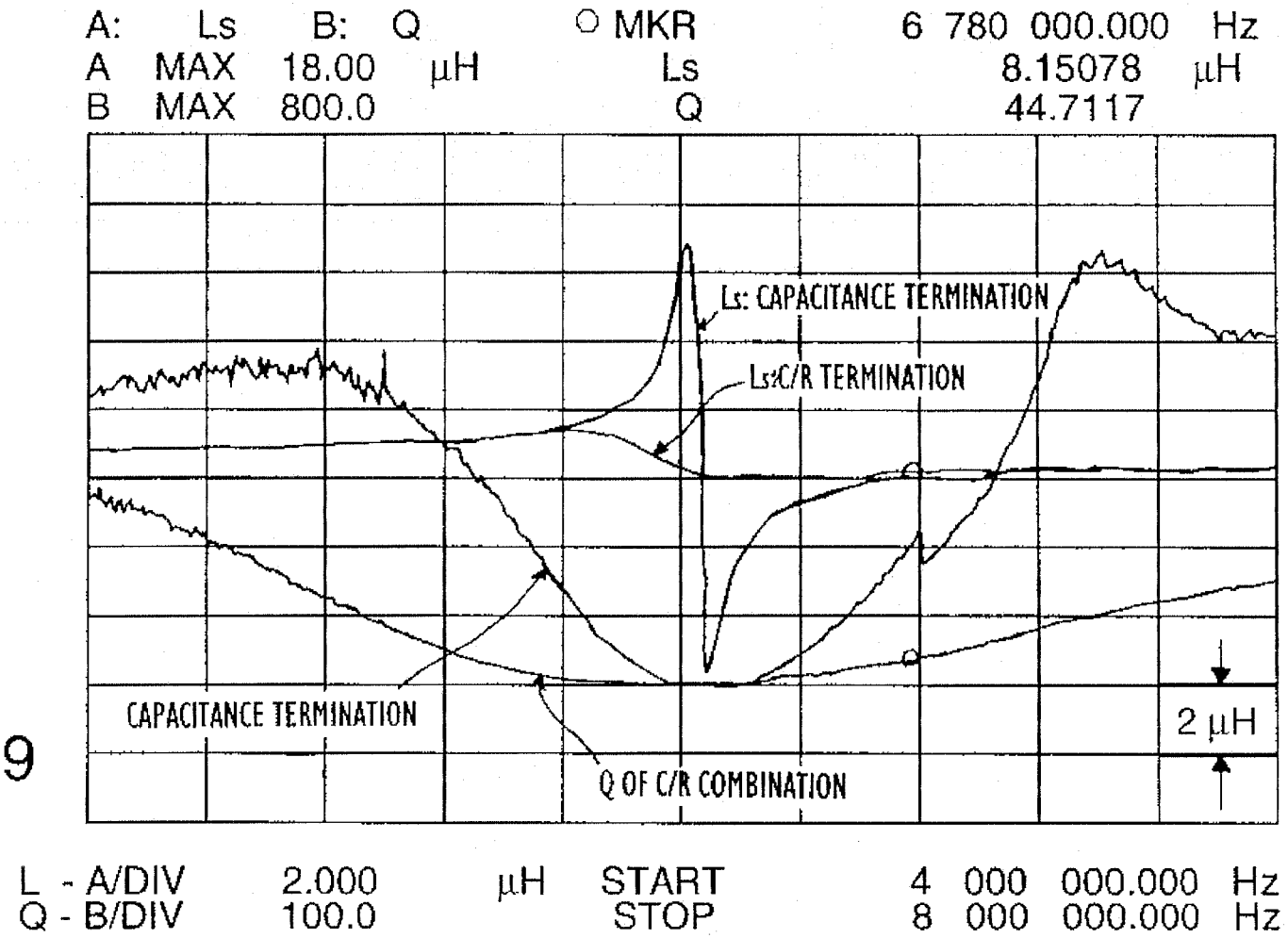
FIG. 9 is a diagram showing the variation in primary coil inductance and quality factor "Q" over a frequency spectrum between 4 and 8 MHz for the capacitor termination and the C/R termination.

The variation in primary coil inductance and "Q" factor over a frequency spectrum between 4 and 8 MHz for the capacitor termination and the C/R termination is illustrated if FIG. 9. With a capacitor termination the maximum primary coil inductance is ±75% of its value without shielding. This dramatic inductance variation indicates that at the resonance, the effect of the shielding loop on the primary coil characteristic is quite strong. Note, however at the frequency where this device is most effective in shielding magnetic flux (about 300 to 400 KHz above resonance) the change in primary coil impedance is less than 10%. It is unlikely that this small change in primary coil impedance will affect the operation of a discharge lamp. The change in primary coil inductance for the C/R termination is much smaller.

The data on the variation of "Q" factor of the primary coil with frequency is also shown in FIG. 9. The C/R termination gives a broad minimum in "Q" factor that is probably impractically low. The variation in "Q" factor of the capacitively terminated loop is considerably sharper and, except near resonance, "Q" factor is considerably higher than that of the C/R termination ("Q" factor scaling in FIG. 9 is 100/div). At 6.78 MHz, for example, the "Q" factor of the capacitor termination is about 160 which would result in only a very small increase in primary coil loss due to shielding. The data, shown in FIGS. 8 and 9, suggests that a reduction of resistance in the shielding loop 23 results in an increase in shielding effectiveness along with a reduction of power dissipation in the primary coil 18 due to the mutual coupling with the shielding loop 23.

As schematically shown in FIG. 2, the shielding loop 23 is disposed outside the lamp envelope 14. The shielding loop 23 may be formed as a ring (for instance, copper) or as a conductive film deposited on the glass wall 21 of the lamp envelope 14. The film should be a fairly good conductor so it does not dissipate too much energy.

Figure 11:
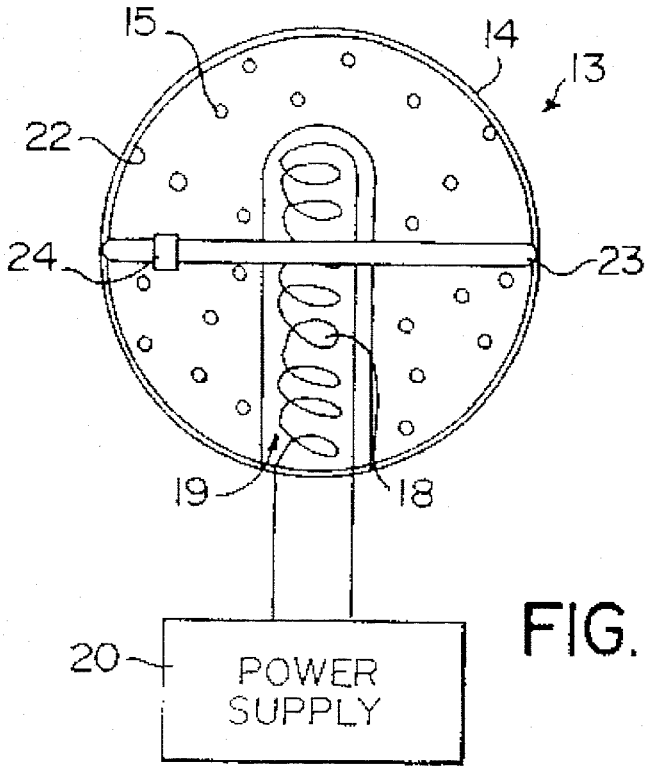
FIG. 11 shows, schematically, a shielding loop of the present invention secured inside the lamp envelope.

However, there is conceptually no reasons why the shielding loop 23 (in form of a ring or a film) could not be placed inside the lamp envelope 14 (as best shown in FIG. 11). Of course, any issues of the compatibility of materials between the shielding loop 23 and the gaseous medium (for instance, mercury) inside the lamp envelope should be considered. For example, if mercury is a part of the gaseous medium, a copper metal ring open to the lamps atmosphere would not be a good choice because it interacts with mercury in a way deleterious to lamp operation. Tungsten might be a good choice from the mercury compatibility point of view. In addition, one has to use a capacitor material that is encapsulated so that it does not outgas and that is compatible with the mercury/buffer gas discharge atmosphere.

Figure 10:
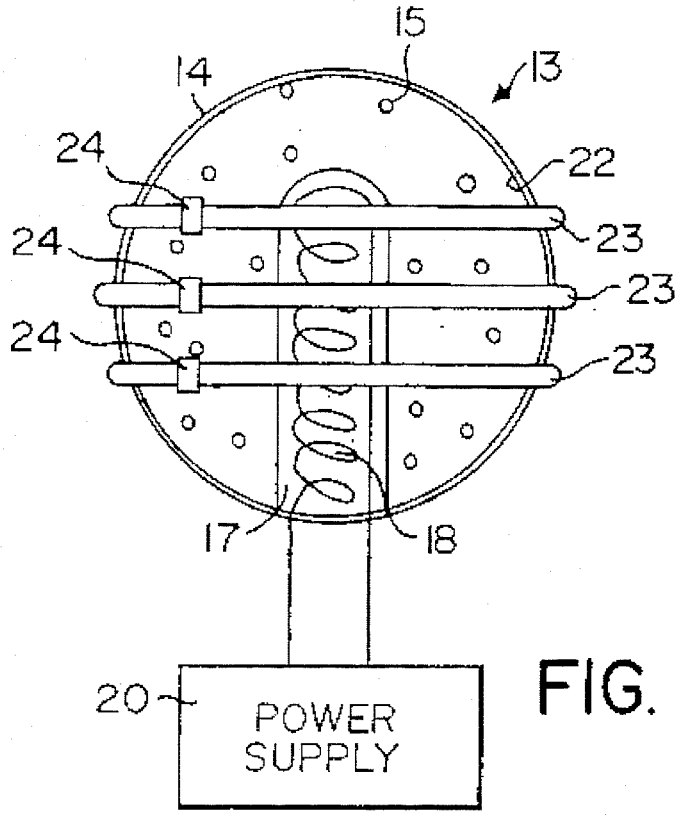
FIG. 10 shows, schematically, a plurality of independent shielding loops of the present invention.
Figure 12:
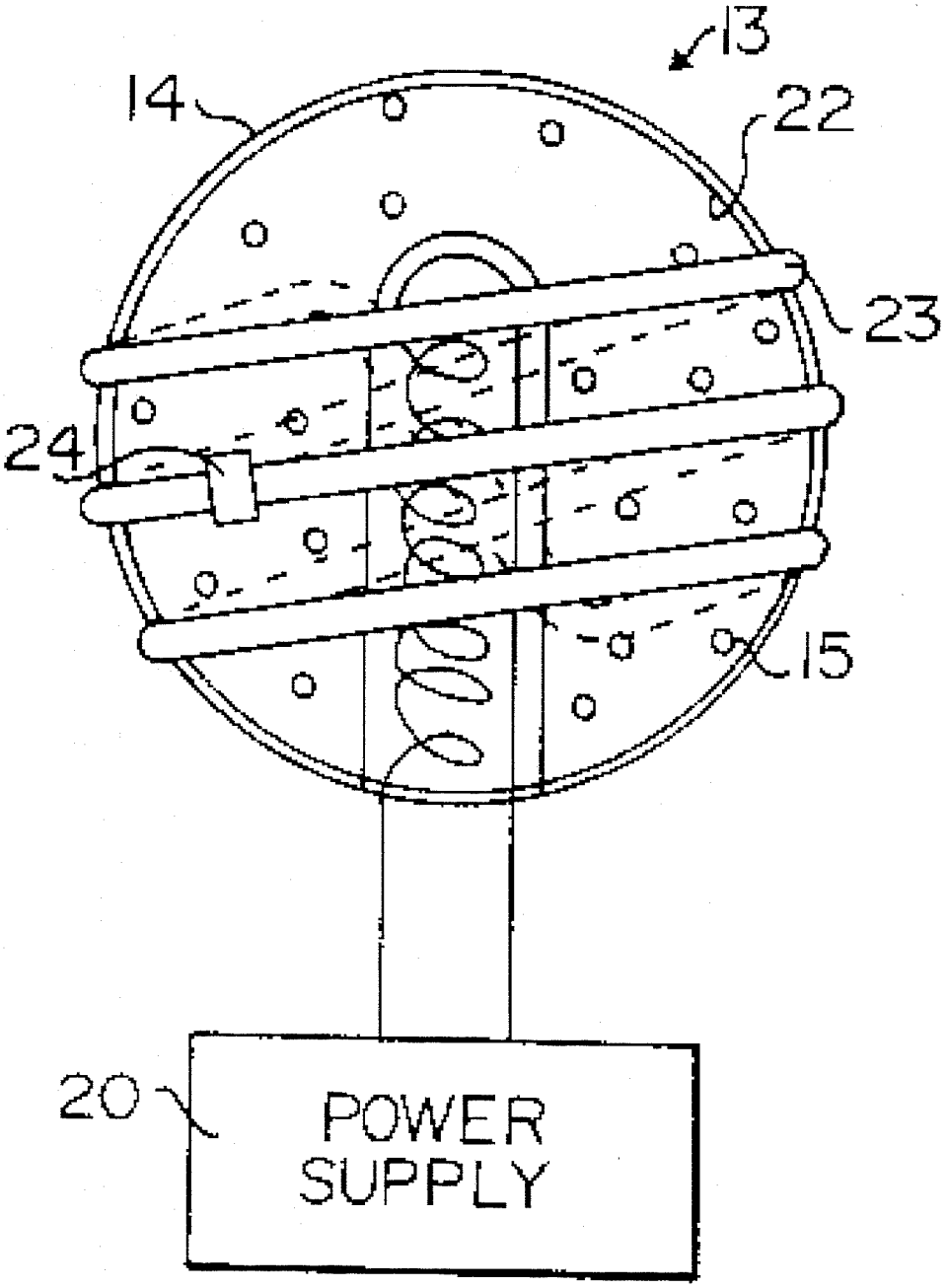
FIG. 12 shows, schematically, a multi-turn shielding loop of the present invention.

More than one shielding loop 23 can be employed for shielding the external magnetic interferences. The criteria for more than one loop is simply determined by the amount of shielding required. Two shielding loops 23 will be more effective than one (although not twice as effective). As with a single shielding loop, a multitude of shielding loops would be most effective when the plane of the loops is parallel to the plane of the driven primary unit. The shielding loops may be independent from each other (as best shown in FIG. 10), or a multi-turn shielding loop may be employed (as best shown in FIG. 12) rather than a multitude of independent loops 23. The multi-turn shielding loop would require less capacitance to resonate.

The best place for the shielding loop 23 is in the midplane of the discharge although it doesn't have to be precisely there. It could also be placed off center of the midplane. The loop 23 has to be near enough to the driven inductor so that sufficient coupling can be attained to induce the current necessary to minimize or reduce the magnetic flux of the driven inductor 19. If the loop 23 is external to the bulb 16, it is easy to deposit a copper metalized film ring on the glass surface (for example, by plasma vapor deposition), such that the film ring is broken at some point where the termination capacitor 24 is connected. Maximum EMI suppression occurs when the shielding loop 23 is made of the highest conductivity material; however, considerable EMI reduction can still be achieved with less conductive ring material. Incidentally, the termination capacitor 24 can be made very small because it need only be rated for a few volts at most.

The present invention constitutes a new technique to reduce magnetic interference from an inductively coupled discharge which, in practice, is an order of magnitude more effective than that described in the prior art. This invention demonstrates that external magnetic interference from a driven inductor can be reduced by surrounding the inductor with a terminated loop whose resonant frequency is slightly lower than that of the driving frequency. The results suggest that the total resistance of the shielding loop circuit strongly affects the shielding effectiveness and also affects the power transfer efficiency. Adding resistance to the shielding loop circuit reduces the "Q" factor of the primary coil and results in making the resonance more broad banded, reducing the magnitude of magnetic shielding and increasing the power deposition in the shielding loop. Quantitatively, the relation between the shielding loop resistance and the primary coil characteristics is affected by the exact geometry of the primary coil and the shielding loop, the coupling between the two loops and the difference between the shielding loop resonant frequency and the driving frequency. Although the technique has been discussed in association with an electrodeless low pressure discharge lamp, it may be considered for EMI reduction in different applications. A simple EMI reduction technique is described above that significantly reduces external magnetic flux from an inductor coil driven by an radio frequency source. This technique substantially reduces magnetic interference emitted from any inductive discharge maintained by an air core inductor or any ferrite core inductor as long as the ferrite core does not form a closed magnetic path.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method for reducing an external magnet flux emitted from an inductor surrounded by an ionizable gaseous medium, wherein the inductor includes a primary coil driven with a predetermined driving radio frequency to maintain an inductive discharge, the method comprising the steps of:

surrounding the inductor with at least one shielding conductive loop having an inductance, terminating said at least one shielding loop in a capacitive termination to resonate with said at least one shielding loop, and providing a resonant frequency of the capacitive termination in series with the inductance of the shielding loop below the predetermined driving frequency of the primary coil.

2. The method of claim 1, wherein the inductive discharge is maintained in an electrodeless low pressure discharge lamp, further including the steps of:

providing a sealed transparent lamp envelope filled with said gaseous medium, said gaseous medium including a rare gas and a vaporized metal, the inductor being received in the lamp envelope, disposing a layer of a fluorescent material on an internal surface of the lamp envelope, providing means for applying a high-frequency power to said primary coil to produce an electro-magnetic field within the lamp envelope for maintaining the inductive discharge in said gaseous medium, said fluorescent material being responsive to the discharge in the gaseous medium for emitting light.

3. The method of claim 2, further comprising the step of securing the shielding loop outside the lamp envelope.

4. The method of claim 2, further including the step of securing the shielding loop inside of the lamp envelope.

5. The method of claim 1, further including the steps of surrounding the inductor with a plurality of independent shielding loops, each terminated in a respective capacitive termination.

6. The method of claim 1, wherein said shielding loop includes a multi-turn conductive ring terminated in the capacitive termination.

7. The method of claim 1, further including the step of positioning the shielding loop in the mid-plane of the primary coil.

8. The method of claim 1, wherein the inductor includes an air-core inductor.

9. The method of claim 1, wherein the inductor includes a ferrite-core inductor.

10. A method for reducing an external magnet flux found outside an electrodeless low pressure discharge lamp, comprising the steps of:

providing a sealed transparent lamp envelope filled with an ionizable gaseous medium, said gaseous medium including a rare gas and a vaporized metal, disposing a layer of fluorescent material on an internal surface of the lamp envelope, providing an inductor within the lamp envelope, the inductor including a primary coil, providing means for applying a power having a predetermined driving radio frequency to said primary coil to produce an electro-magnetic field within the lamp envelope for maintaining an inductive discharge in said gaseous medium, said fluorescent material being responsive to the discharge in the gaseous medium for emitting light, surrounding the inductor with at least one shielding conductive loop, terminating said at least one shielding loop in a capacitive termination to resonate said at least one shielding loop, and providing a resonant frequency of the capacitive termination in series with an inductance of the shielding loop below the predetermined driving frequency of the primary coil.

11. A discharge lamp with reduced external magnet interference, comprising:

a sealed transparent lamp envelope filled with an ionizable gaseous medium, said gaseous medium including a rare gas and a vaporized metal, a layer of fluorescent material disposed on an internal surface of the lamp envelope, an inductor received within the lamp envelope, the inductor including a primary coil, means for applying a power of a predetermined driving radio frequency to said primary coil to produce an electro-magnetic field within the lamp envelope for maintaining an inductive discharge in said gaseous medium, said fluorescent material being responsive to the discharge in the gaseous medium for emitting light, at least one shielding conductive loop surrounding the inductor, and said at least one shielding loop being terminated in a capacitive termination to resonate with said at least one shielding loop, wherein a resonant frequency of the capacitive termination in series with an inductance of the shielding loop is maintained below the predetermined driving frequency of the primary coil.

12. The discharge lamp of claim 11, wherein said at least one shielding loop is secured outside the lamp envelope.

13. The discharge lamp of claim 11, wherein said at least one shielding loop is secured inside of the lamp envelope.

14. The discharge lamp of claim 11, wherein the inductor is surrounded with a plurality of independent shielding loops, each terminated in a respective capacitive termination.

15. The discharge lamp of claim 11, wherein said shielding loop includes a multi-turn conductive ring terminated in the capacitive termination.

16. The discharge lamp of claim 11, wherein said at least one shielding loop is positioned in the mid-plane of the primary coil.

17. The discharge lamp of claim 11, wherein the inductor includes an air-core inductor.

18. The discharge lamp of claim 11, wherein the inductor includes a ferrite-core inductor.

19. The discharge lamp of claim 11, wherein the lamp envelope and the gaseous medium are selected for operation at a frequency of more than one MHz.

20. The discharge lamp of claim 11, wherein the rare gas is selected from the group consisting of argon, hrypton, xenon and neon.

21. The discharge lamp of claim 11, wherein the vaporized metal is selected from the group consisting of mercury and sodium.

22. The discharge lamp of claim 11, wherein said at least one shielding loop includes a conductive film deposited on the lamp envelope.

* * * * *